US012685356B1

(12) United States Patent
Chen

(10) Patent No.: US 12,685,356 B1
(45) Date of Patent: Jul. 21, 2026

(54) ARTIFICIAL FLOWER

(71) Applicant: Dongguan Xinyu Intelligent Technology Co., Ltd., Dongguan (CN)

(72) Inventor: Yan Chen, Chengdong (CN)

(73) Assignee: Dongguan Xinyu Intelligent Technology Co., Ltd., Dongguan (CN)

( * ) Notice: Subject to any disclaimer, the term of this patent is extended or adjusted under 35 U.S.C. 154(b) by 0 days.

(21) Appl. No.: 19/221,619

(22) Filed: May 29, 2025

(51) Int. Cl.
*A41G 1/00* (2006.01)

(52) U.S. Cl.
CPC ..... *A41G 1/002* (2013.01)

(58) Field of Classification Search
CPC ..... A41G 1/002
See application file for complete search history.

(56) References Cited

U.S. PATENT DOCUMENTS 530,870 A * 12/1894 Wenger ..... A41G 1/002 40/411
549,039 A * 10/1895 Wenger ..... G09F 19/08 40/411
3,471,964 A * 10/1969 Cherry ..... A63H 33/00 446/268
4,738,881 A * 4/1988 Lee ..... A41G 1/002 428/12
5,522,758 A * 6/1996 Liu ..... A63H 13/00 40/411
6,389,718 B1 * 5/2002 Joo ..... A41G 1/002 40/412
7,842,359 B2 * 11/2010 Marlow ..... A41G 1/005 446/241
7,861,444 B2 * 1/2011 Marlow ..... A41G 1/002 40/411
7,861,445 B2 * 1/2011 Sui ..... A41G 1/002 40/414
8,133,090 B2 * 3/2012 Hardin ..... A63H 3/50 446/268
8,757,576 B2 * 6/2014 Kersting ..... A01G 5/04 248/354.3
9,144,258 B2 * 9/2015 Krivanek ..... A41G 1/002
9,573,644 B2 * 2/2017 Teitel ..... F21V 15/01
9,878,261 B1 * 1/2018 Fung ..... A63H 33/26
10,117,483 B2 * 11/2018 Fukui ..... A44C 17/02
10,362,821 B2 * 7/2019 Lee ..... F16M 11/041
11,788,713 B2 * 10/2023 Huang ..... F21S 9/02 362/122

(Continued)

FOREIGN PATENT DOCUMENTS

CN 214016195 U * 8/2021 ..... A41G 1/00

OTHER PUBLICATIONS

Yao, Machine Translation of CN-214016195-U,uploaded Jan. 7, 2026, Espacenet, 6 pages.*

*Primary Examiner* — Michael D Dennis
*Assistant Examiner* — Matthew B Stanczak
(74) *Attorney, Agent, or Firm* — Jose Cherson Weissbrot

(57) ABSTRACT

The present disclosure provides an artificial flower, which includes a body provided with a hollow cavity, a driving part mounted in the hollow cavity, and a power member mounted on the body and configured to control a directional movement of the driving part along the hollow cavity; and through holes are formed in a side wall of the hollow cavity, and flowering branches pass through the through holes to be connected to the driving part.

6 Claims, 13 Drawing Sheets

(56) References Cited

U.S. PATENT DOCUMENTS

| | | | | |
|---|---|---|---|---|
| 2008/0311316 | A1* | 12/2008 | Marlow | A41G 1/002 251/5 |
| 2010/0307569 | A1* | 12/2010 | Sui | A41G 1/002 136/252 |
| 2012/0121826 | A1* | 5/2012 | Marlow | A41G 1/001 428/24 |
| 2013/0078395 | A1* | 3/2013 | Krivanek | A41G 1/002 428/26 |
| 2015/0342277 | A1* | 12/2015 | DeMerchant | A41G 1/001 29/428 |
| 2016/0311488 | A1* | 10/2016 | Teitel | F21S 9/02 |
| 2019/0053559 | A1* | 2/2019 | Lee | F16M 11/041 |

* cited by examiner

ARTIFICIAL FLOWER

TECHNICAL FIELD

Embodiments of the present disclosure relate to the technical field of artificial flowers, and in particular to an artificial flower.

BACKGROUND

As the living standards increase, the aesthetic pursuit of people also continuously increases. For example, a variety of flowers are arranged in various occasions, such as families, hotels, or shopping malls, in order to create a better visual enjoyment. Natural plants and flowers need long-term and regular watering and fertilization, which brings higher planting costs. Therefore, artificial flowers become a good choice.

SUMMARY

An embodiment of the present disclosure provides an artificial flower, including:

a body provided with a hollow cavity;

a driving part mounted in the hollow cavity;

a power member mounted on the body and configured to control a directional movement of the driving part along the hollow cavity; and flowering branches, through holes being formed in a side wall of the hollow cavity, and the flowering branches passing through the through holes to be connected to the driving part;

where the flowering branch includes a rotating head, a rotating arm and a connecting portion, the rotating head being connected to the driving part, one end of the rotating arm being connected to the rotating head, and the other end of the rotating arm being connected to the connecting portion.

DETAILED DESCRIPTION OF EMBODIMENTS

Figure 1:
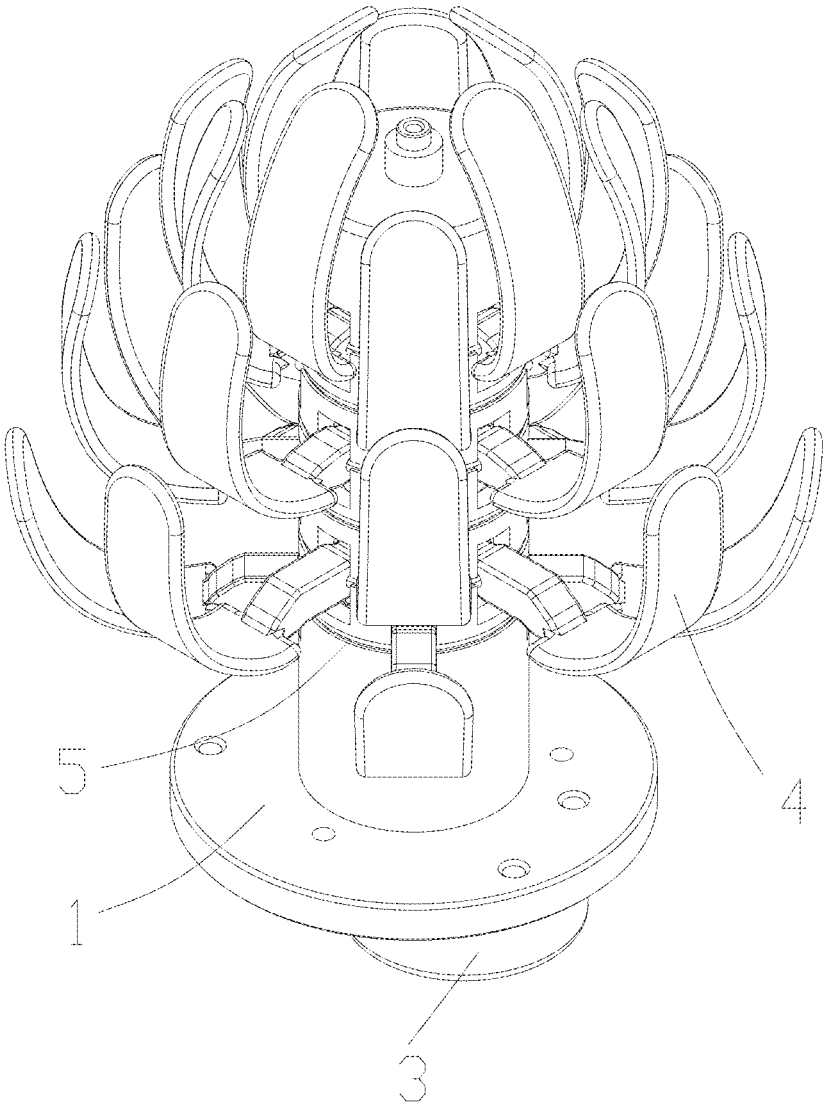
FIG. 1 is a perspective view of an artificial flower according to an embodiment of the present disclosure.
Figure 2:
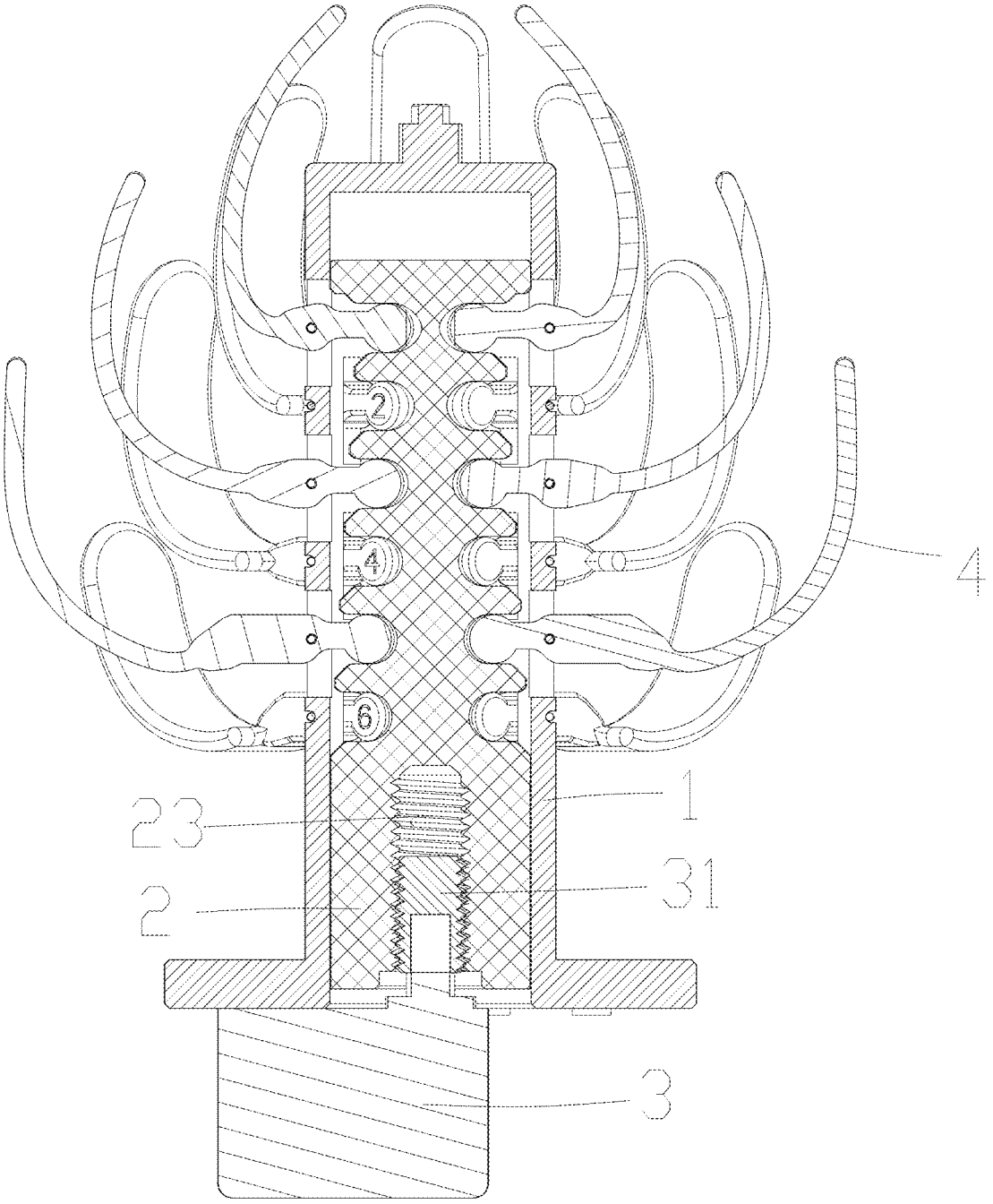
FIG. 2 is a cross-sectional view of an artificial flower in a retracted state according to an embodiment of the present disclosure.

The present disclosure will be further described in detail below through specific implementations with reference to the accompanying drawings. It should be understood that the embodiments described below with reference to the accompanying drawings are exemplary and are intended to illustrate the present disclosure, and will not be interpreted as limiting the present disclosure. In addition, the features in the embodiments of the present disclosure may be combined with each other without conflict.

As shown in FIGS. 1-12, the present disclosure provides an artificial flower, including a body 1 provided with a hollow cavity 11, a driving part 2 mounted in the hollow cavity 11, and a power member 3 mounted on the body 1 and configured to control a directional movement of the driving part 2 along the hollow cavity 11; and through holes 12 are formed in a side wall of the hollow cavity 11, and flowering branches 4 pass through the through holes 12 to be connected to the driving part 2.

According to the present disclosure, by providing the hollow cavity 11 in the body 1 and providing the driving part 2 in the hollow cavity 11, the driving part 2 is driven by the power member 3 to vertically move, and the flowering branches 4 can thus be driven by the driving part 2 to vertically swing, such that flower petals may present different states under the drive of the flowering branches 4, and styles of the artificial flower can be increased, which is more beneficial to display and use.

Figure 3:
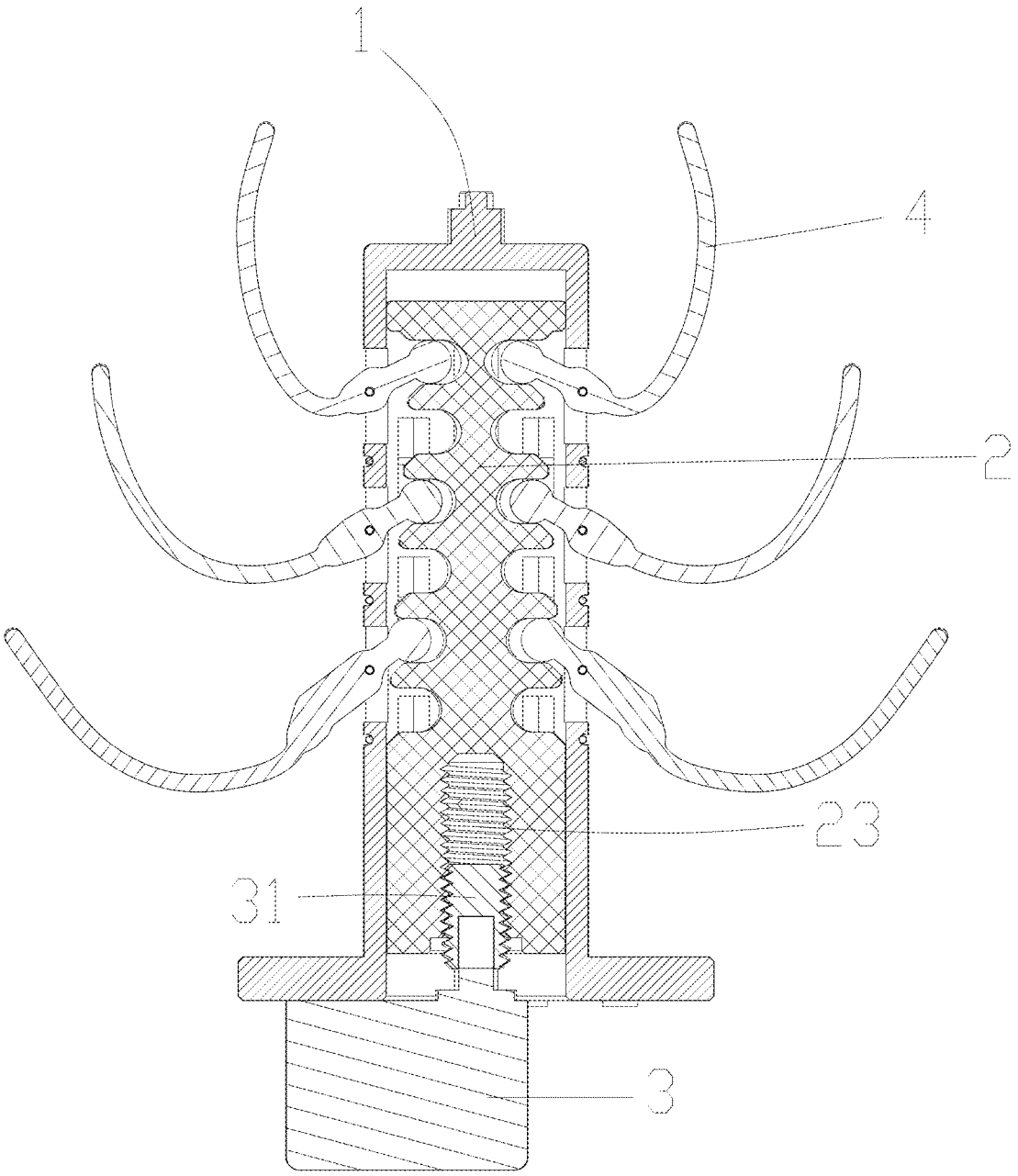
FIG. 3 is a cross-sectional view of an artificial flower in a deployed state according to an embodiment of the present disclosure.
Figure 4:
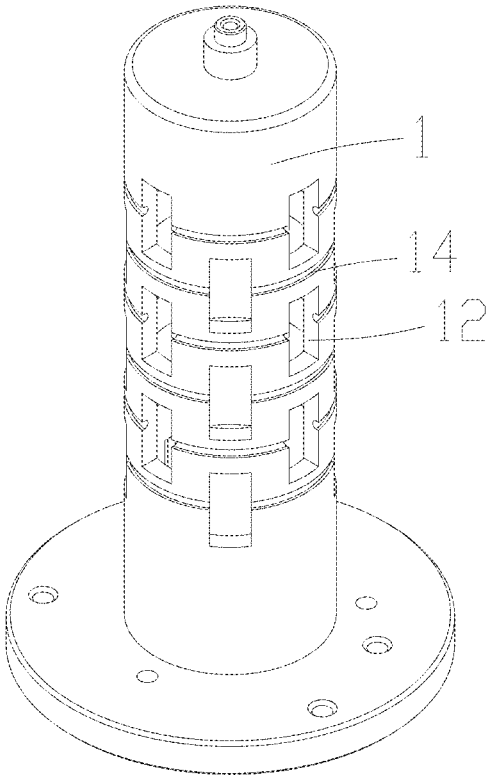
FIG. 4 is a perspective view of a body of an artificial flower according to an embodiment of the present disclosure.
Figure 5:
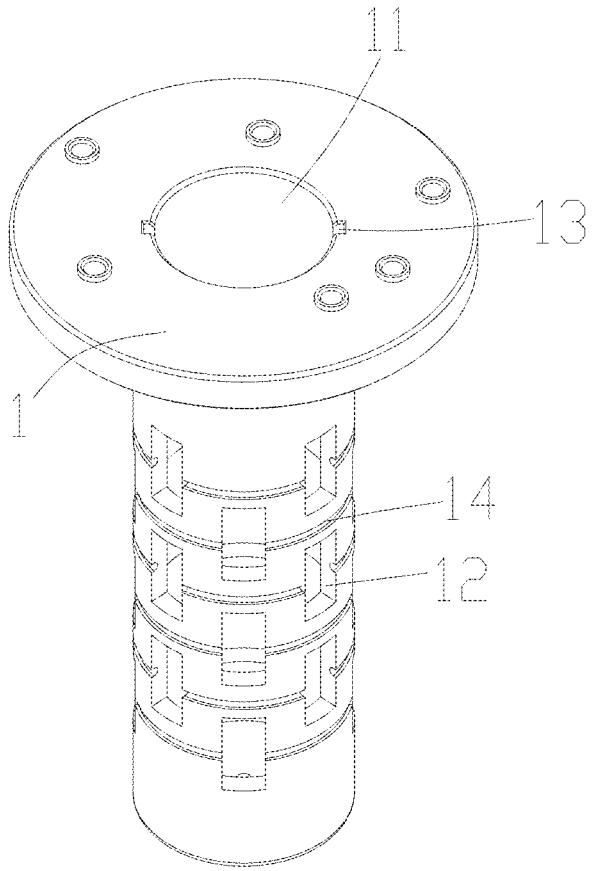
FIG. 5 is a perspective view of a body of an artificial flower according to a further embodiment of the present disclosure.

As shown in FIG. 5, in some embodiments, the side wall of the hollow cavity 11 is further provided with a first guide portion 13, and the driving part 2 is provided with a second guide portion 21 for cooperative use with the first guide portion 13. In some embodiments, as shown in FIG. 3, a screw hole 23 is formed in an end of the driving part 2 connected to the power member 3, a screw rod 31 is disposed at an output end of the power member 3, and the screw rod 31 is screwed into the screw hole 23. The first guide portion 13 is an elongated guide groove, the second guide portion 21 is an elongated projection matching the shape of the guide groove, and the elongated projection is slidable within the guide groove 13 and is configured to constrain the movement of the driving part 2 in a length direction of the guide groove.

Figure 13:
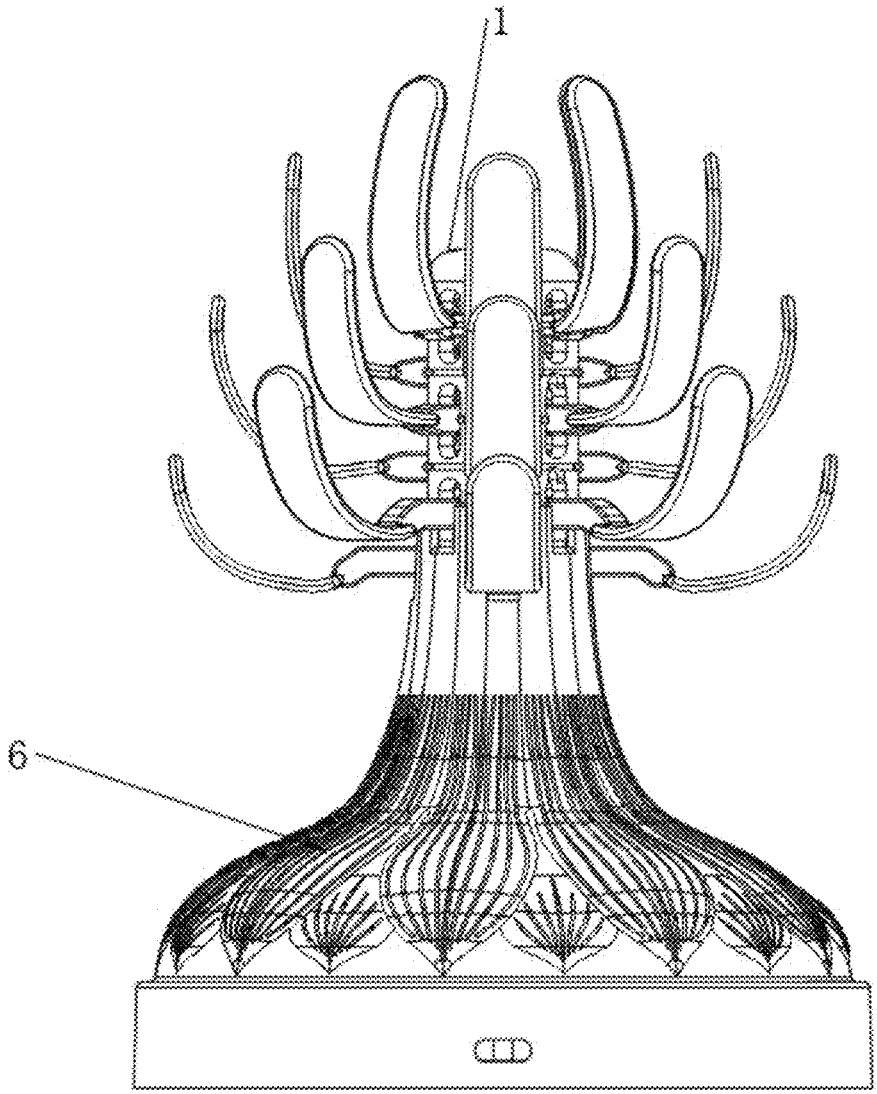
FIG. 13 is a perspective view of an artificial flower according to yet another embodiment of the present disclosure.
Figure 14:
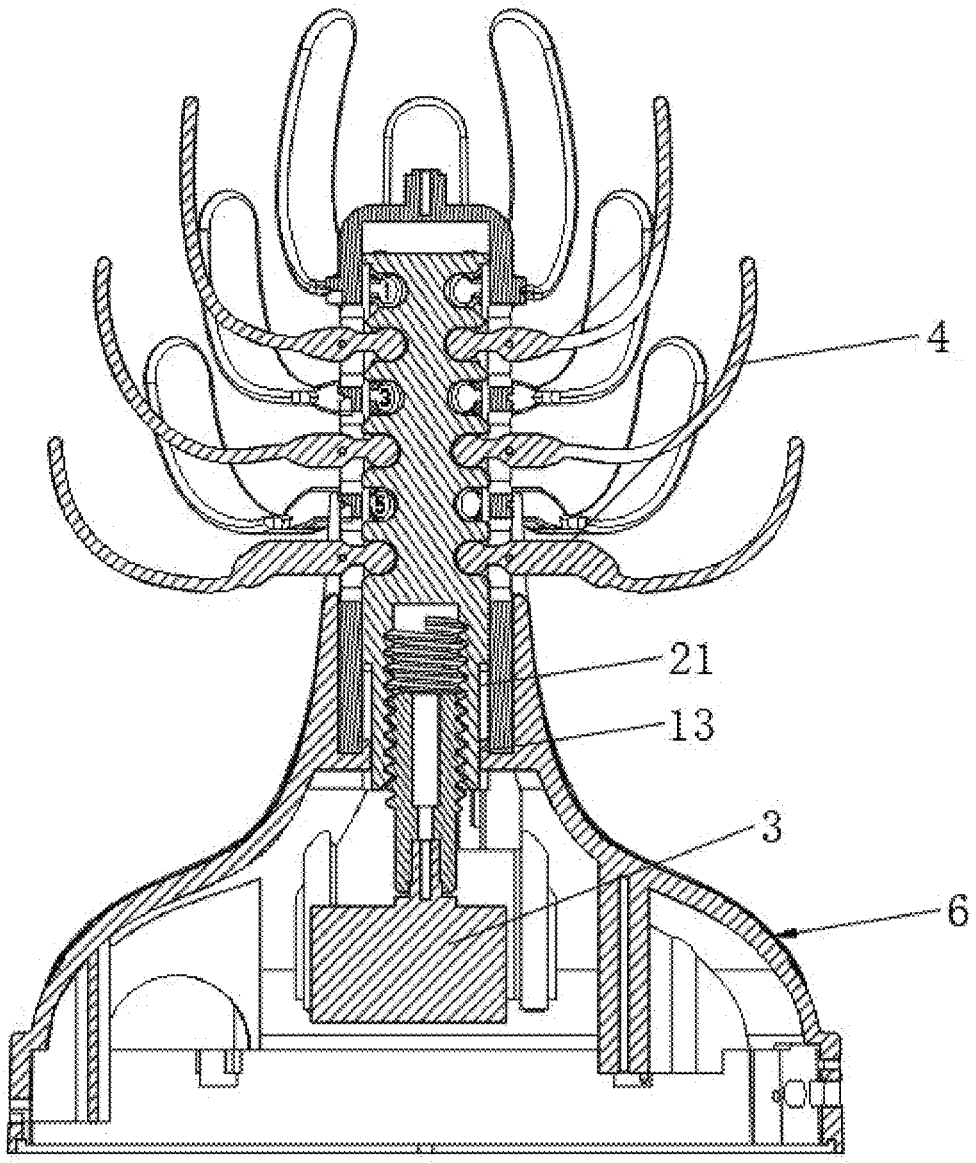
FIG. 14 is a schematic structural diagram of a longitudinal section of FIG. 13.

In other embodiments, as shown in FIGS. 13 and 14, the second guide portion 21 is an elongated guide groove disposed on the driving part 2, the first guide portion 13 is an elongated projection matching the shape of the guide groove, the first guide portion 13 is provided on an inner wall of a base 6, and the elongated projection is slidable within the guide groove for constraining the movement of the driving part 2 in the length direction of the guide groove.

The base 6 is the bottom of the body 1, the bottom of the body 1 is designed in an expanded shape to form the base 6, a base 6 may also be inserted directly at the bottom of the body 1, and it will be appreciated that the bottom of the body 1 may be of other shape such as a disk shape, which is not strictly limited herein.

Figure 6:
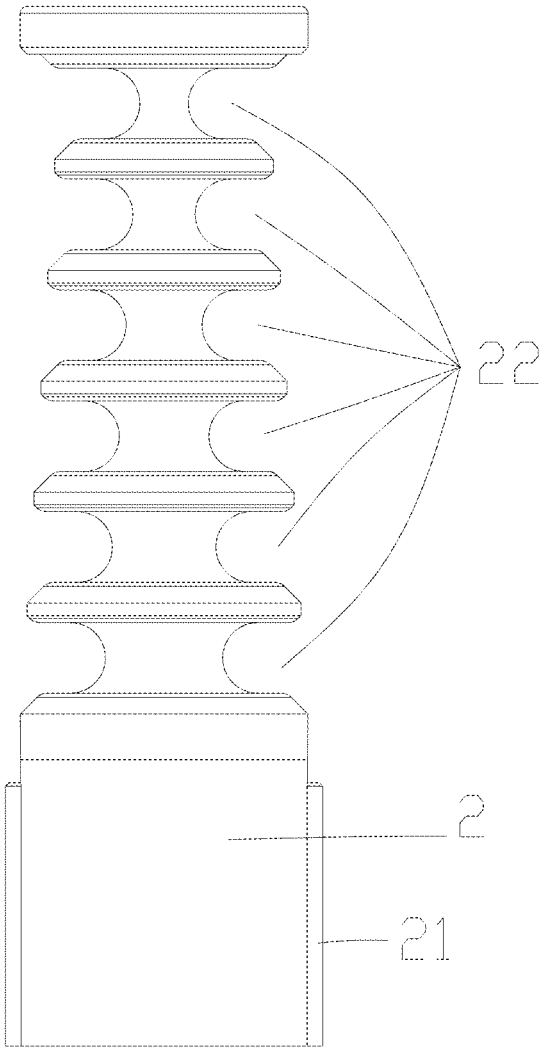
FIG. 6 is a front view of a driving part of an artificial flower according to an embodiment of the present disclosure.
Figure 7:
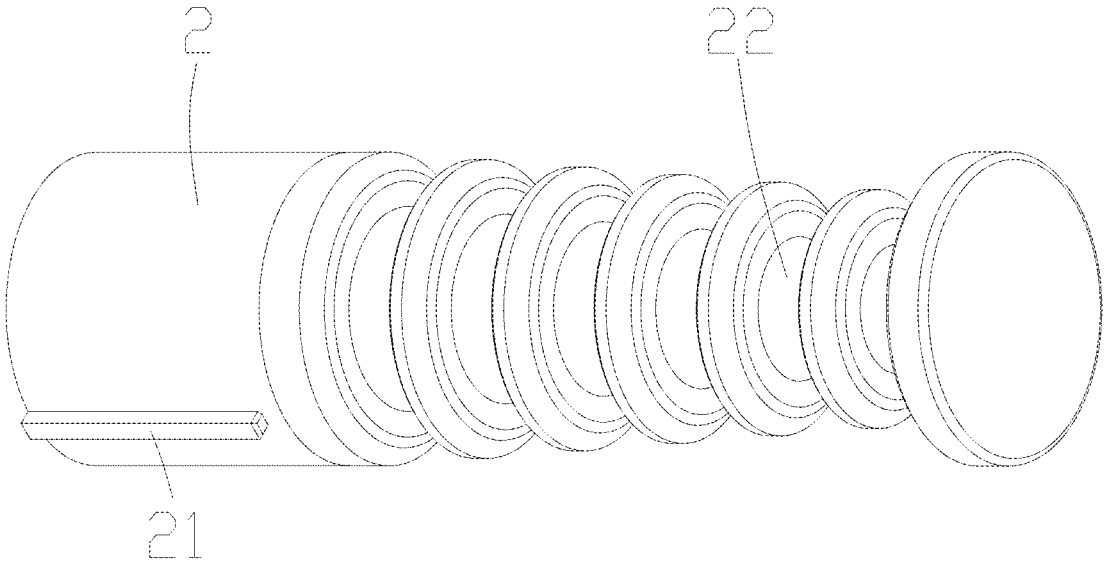
FIG. 7 is a perspective view of a driving part of an artificial flower according to an embodiment of the present disclosure.
Figure 8:
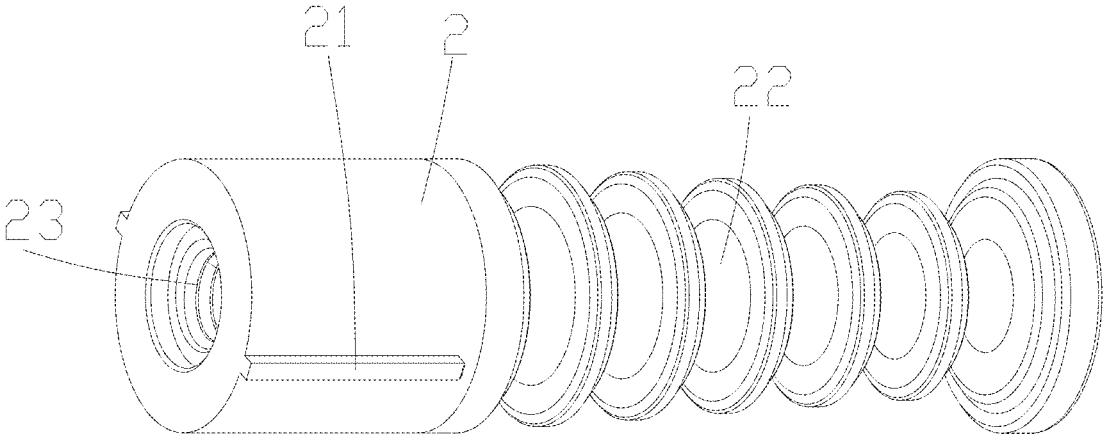
FIG. 8 is a perspective view of a driving part of an artificial flower according to a further embodiment of the present disclosure.
Figure 9:
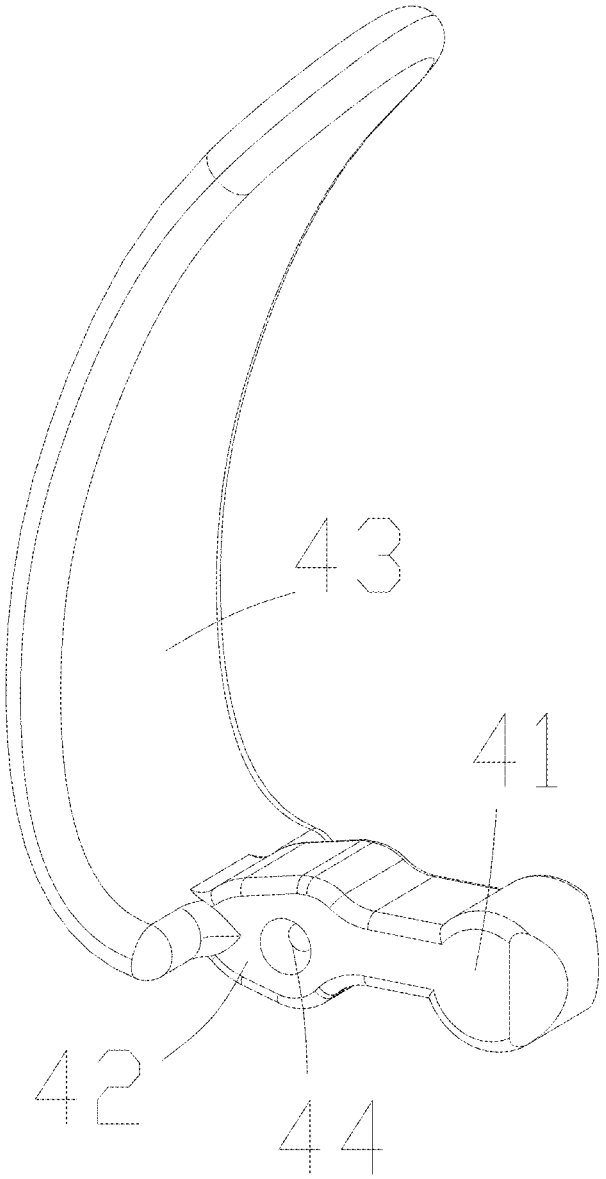
FIG. 9 is a perspective view of a flowering branch of an artificial flower according to an embodiment of the present disclosure.
Figure 10:
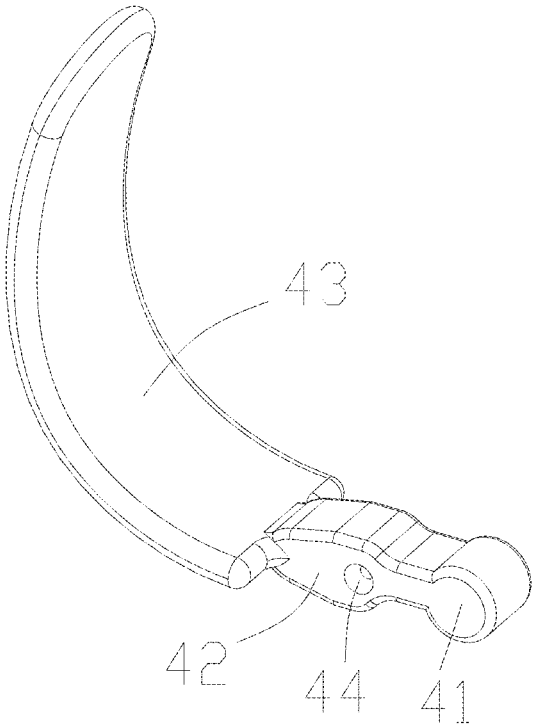
FIG. 10 is a perspective view of a flowering branch of an artificial flower according to a further embodiment of the present disclosure.
Figure 11:
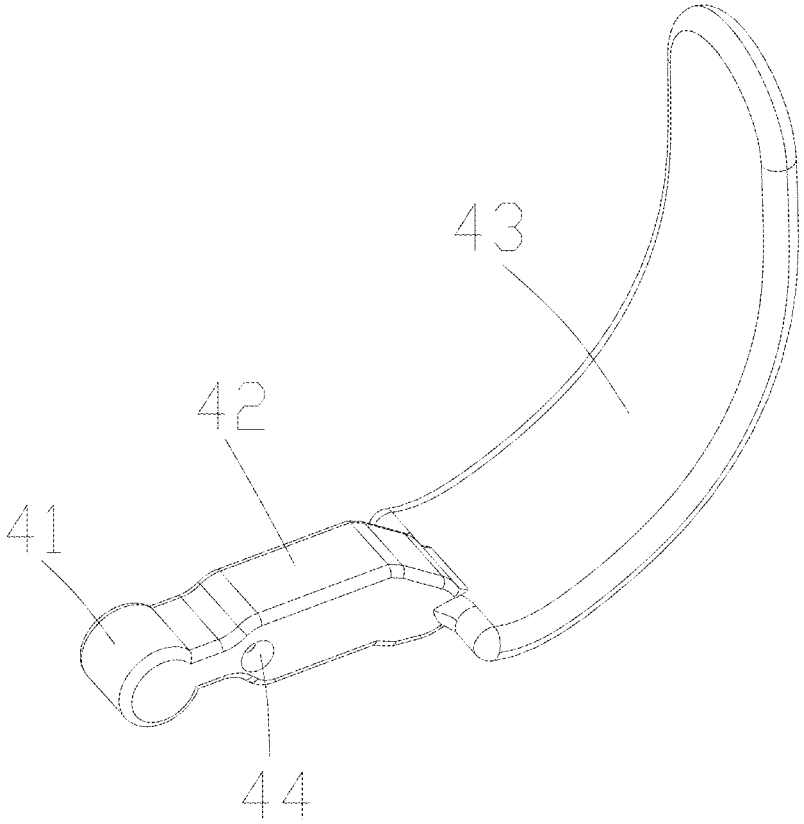
FIG. 11 is a perspective view of a flowering branch of an artificial flower according to another embodiment of the present disclosure.

Referring to FIGS. 5 to 7, by providing the first guide portion 13 and the second guide portion 21, the driving part 2 can be driven to directionally move along the first guide portion 13, meanwhile, the driving part 2 can also be prevented from rotating, thereby the power member 3 drives the screw rod 31, and thus upward and downward directional movement of the driving part 2 can be achieved by cooperative use of the screw rod 31 and the screw hole 23.

In some embodiments, the flowering branch 4 includes a rotating head 41 connected to the driving part 2, a rotating arm 42 connected to the rotating head 41, and a connecting portion 43, where the connecting portion 43 is connected to an end of the rotating arm 42 away from the rotating head 41. A plurality of layers of flowering branches 4 are provided, the lengths of the rotating arms 42 of each layer of flowering branches 4 successively increase from an uppermost layer to a lowermost layer, and meanwhile, included angles between the connecting portions 43 and the rotating arms 42 successively increase from the uppermost layer to the lowermost layer; and the longer the rotating arms 42, the greater the included angles, the greater opening angles of the flowering branches 4, and the more conducive to the deployment and retraction of the entire artificial flower. In some embodiments, the connecting portion 43 is configured to be connected to a flower petal.

In some embodiments, the rotating arm 42 is connected to the through hole 12 by means of a rotating shaft 5. A plurality of rows and a plurality of columns of through holes 12 are provided. In some embodiments, the middle of the through hole 12 is provided with an accommodating slot 14 for accommodating the rotating shaft 5 to facilitate the connection of the rotating arm 42 to the through hole 12. In some embodiments, the rotating arm 42 is provided with a rotating hole 44 for connecting the rotating shaft 5. In some embodiments, a snap ring may be used as the rotating shaft 5.

In some embodiments, the driving part 2 is provided with a plurality of layers of connecting grooves 22 for connecting the flowering branches 4, and the depths of the connecting grooves 22 gradually become larger from bottom to top.

In some embodiments, the larger the depth of the connecting groove 22, the smaller a distance by which the rotating arm 42 remains outside the body 1, and accordingly an angle at which the flowering branches 4 are deployed is smaller, which is conducive to adjusting the deployment angle of each layer of the flowering branches 4.

Figure 12:
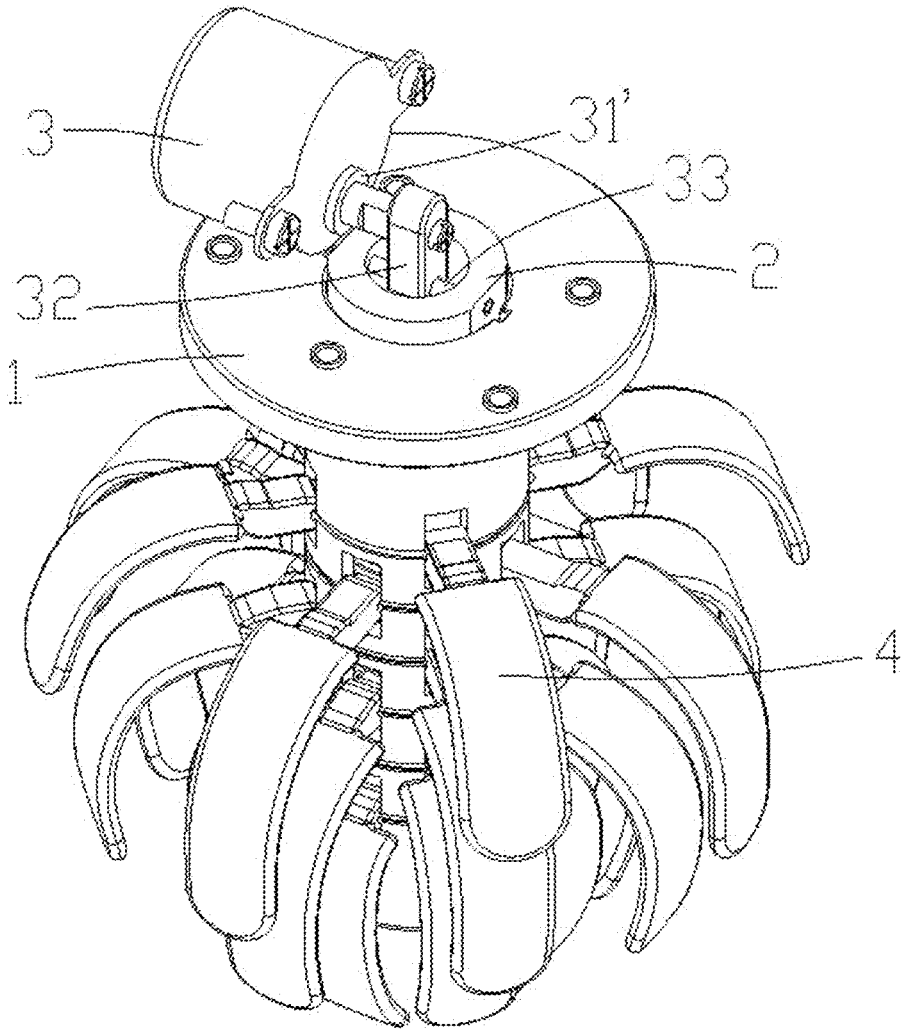
FIG. 12 is a perspective view of an artificial flower according to still another embodiment of the present disclosure.

Referring to FIG. 12, in some embodiments, an eccentric wheel 31' (see FIG. 12) is disposed at the output end of the power member 3, and the eccentric wheel 31' is provided with a transmission rod 32 connected to one end of the driving part 2 and configured to drive the driving part 2 to vertically move. In some embodiments, a rotating shaft 33 is disposed at an end of the transmission rod 32 connected to the driving part 2, and the transmission rod is connected to the driving part 2 by means of the rotating shaft 33. The power member 3 rotates by driving the eccentric wheel 31' and drives the transmission rod 32 to move by using the eccentric wheel 31', so that the driving part 2 can be driven to vertically move, thus achieving the deployment and retraction of the flowering branches 4 more conveniently.

According to the present disclosure, by providing the hollow cavity 11 in the body 1 and providing the driving part 2 in the hollow cavity 11, the driving part 2 is driven by the power member 3 to vertically move, and the flowering branches 4 can thus be driven by the driving part 2 to vertically swing, such that flower petals may present different states under the drive of the flowering branches 4, and styles of the artificial flower can be increased, which is more beneficial to display and use.

Although the embodiments of the present disclosure have been illustrated and described, those of ordinary skill in the art should understood that various changes, modifications, substitutions, and variations may be made to these examples without departing from the principle and spirit of the present disclosure, and the scope of the present disclosure is defined by the appended claims and an equivalent scope thereof.

What is claimed is:

1. An artificial flower, comprising:

a body provided with a cavity;

a driving part mounted in the cavity;

a power member mounted on the body and configured to control a directional movement of the driving part along the cavity; and flowering branches, through holes being formed in a side wall of the body, and the flowering branches passing through the through holes to be connected to the driving part; wherein the flowering branch comprises a rotating head, a rotating arm and a connecting portion, the rotating head being connected to the driving part, one end of the rotating arm being connected to the rotating head, and the other end of the rotating arm being connected to the connecting portion, the flowering branches comprises a plurality of layers, lengths of the rotating arms of each layer of the plurality of layers of the flowering branches and angles between the connecting portions and the rotating arms are increased from an uppermost layer to a lowermost layer of the plurality of layers of the flowering branches, and wherein the driving part is provided with a plurality of layers of connecting grooves for connecting the flowering branches, and depths of the plurality of layers of the connecting grooves are structurally adapted to become larger from bottom to top of the driving part.

2. The artificial flower of claim 1, wherein the side wall of the body is provided with a first guide portion, and the driving part is provided with a second guide portion, the second guide portion being slidably disposed on the first guide portion and configured to constrain the driving part to slide directionally in a length direction of the first guide portion.

3. The artificial flower of claim 1, wherein the through holes further comprise a plurality of rows and a plurality of columns of the through holes.

4. The artificial flower of claim 1, wherein the artificial flower comprises a rotating shaft, the rotating shaft is connected to the rotating arm through the through holes.

5. The artificial flower of claim 1, wherein a screw hole is formed in an end of the driving part connected to the power member, and a screw rod is disposed at one end of the power member, and the screw rod is screwed into the screw hole.

6. The artificial flower of claim 1, wherein the power member is provided with an eccentric wheel, and the eccentric wheel is provided with a transmission rod connected to one end of the driving part and configured to drive the driving part to vertically move.

* * * * *